US006479208B1

(12) United States Patent
Robertson

(10) Patent No.: US 6,479,208 B1
(45) Date of Patent: Nov. 12, 2002

(54) MARKING OF HOT GLASS USING A CARRIER RIBBON BEARING A LASER ABLATED COATING PATTERN

(75) Inventor: John A. Robertson, Chillicothe, OH (US)

(73) Assignee: Infosight Corporation, Chillicothe, OH (US)

( * ) Notice: Subject to any disclaimer, the term of this patent is extended or adjusted under 35 U.S.C. 154(b) by 0 days.

(21) Appl. No.: 09/971,289

(22) Filed: Oct. 4, 2001

(51) Int. Cl.[7] ..... H01J 9/00; G03C 11/12; G03C 1/805

(52) U.S. Cl. ..... 430/258; 430/259; 430/945

(58) Field of Search ..... 430/256, 258, 430/259, 945

(56) References Cited

U.S. PATENT DOCUMENTS 4,515,867 A * 5/1985 Bleacher et al. ..... 428/204
5,698,366 A * 12/1997 Tutt et al. ..... 430/258
6,165,594 A * 12/2000 Moh et al. ..... 428/207
6,227,394 B1 * 5/2001 Shinoda ..... 220/2.1 A

* cited by examiner

*Primary Examiner*—John A. McPherson
(74) *Attorney, Agent, or Firm*—Mueller and Smith, LPA

(57) ABSTRACT

Method for marking hot glass article having a surface uses a flexible carrier ribbon bearing a laser ablatable, high temperature, diffusely reflective coating, preferably white in color. A pattern is imaged in said coating on carrier ribbon by laser ablation. The patterned carrier ribbon is pressed against the surface only for a time adequate for transferring the patterned coating to the surface. The carrier ribbon then is released from pressing against the surface. The transferred image thickness may be limited by solid particles within the coating.

24 Claims, 3 Drawing Sheets

MARKING OF HOT GLASS USING A CARRIER RIBBON BEARING A LASER ABLATED COATING PATTERN

CROSS-REFERENCE TO RELATED APPLICATIONS

None.

STATEMENT REGARDING FEDERALLY SPONSORED RESEARCH

Not applicable.

BACKGROUND OF THE INVENTION

The present invention generally relates to product marking and identification and more specifically to the marking of hot glass, as typified by picture tube components.

There is a need to piece identify hot glass articles. Picture tube components, for example panels and funnels, start life by being solidified in one of several, say 10, molds. Each piece contains mold related dimensional defects and is uniquely stressed as it is handled, cooled, and then annealed. Of the initially molded pieces, typically more than 30% never have the dimensional accuracy and strength to make it out of the plant.

This 30% loss is tolerable only because the broken (cull) glass can be recycled (one or more times) and, in fact, contributes to a better breed of glass. However, the scrap loss becomes very costly if much processing is done prior to scrapping.

Piece tracking will permit the plant operator to test and update the database for each piece and, thereby, determine if its history supports being scrapped rather than processed.

Suppose that the plant operator knew that mold #7 (and its associated shell) currently was producing dimensionally defective pieces and that they should be scrapped at the lehr exit, where they are known to be "dead on arrival". The downstream costs of processing these parts, through to the first gauging point, could be saved. This, of course, is a simplistic example, because the reason for known defects commonly may involve the interaction of two (or more) machines prior to annealing. The only way such interactions can be discovered quickly is through individual piece tracking.

In the mold #7 hypothetical, the average production rate is assumed to be 5 pieces/minute and that the costs associated with unnecessary post lehr processing is $4.00/piece (this figures includes labor, equipment amortization, consumables (e.g., grinding and polishing materials), maintenance, power, technical support, gauging costs, etc.). If the plant operator can scrap the 10% of production (those pieces formed by mold #7 or another currently defective mold) prior to downstream processing, the plant operator will save over $2.00/minute (approximately $500,000/year). If the post lehr processing equipment throughput is in fact limiting on plant production (especially when a machine is down), the savings can be significantly higher, because a "good" shippable piece can replace every predictably "dead" piece. An additional good piece, of course, is worth far more than $4.00. The beneficial results of piece tracking include more production throughput and a savings when the operator eliminates unnecessary processing of bad pieces.

A variety of techniques for marking hot glass (picture tube panels and funnels) as they exit the forming mold at between about 400° and 650 ° C. can be envisioned. These techniques are listed below along with the problems associated with each:

| | |
|---|---|
| Direct laser marking<br>See for example U.S. PAT. NO. 6,227,394 (Shinoda)<br>Also see C. Buerhop and R. Weismann, "Temperature development of glass during $CO_2$ laser irradiation-Part 1", Glass Technology, Vol. 37 No. 2 (April 1996) | Poor contrast<br>Possible shard/crack generation |
| Glass tag (frit bonded) | Fragile edges of tag<br>Frit melt/temperature/cure match is delicate |
| Spray background (then laser cut away)<br>See for example U.S. PAT. NO. 4,323,755 (Nierenberg) | Overspray<br>Delicate balance between cut/shard<br>Possible shock to glass (nebulizing air)<br>Spray reliability |
| Spray background (then laser blacken) | Overspray<br>More liquid material & thermal shock<br>Spray reliability |
| Pad apply laser darkenable patch | Pad transfer buildup<br>Multiple stamps-requires significant time |
| Tape apply laser darkenable patch | May require 2 stations (cure time)<br>Difficult to formulate adhesion & (clean/strong/black) markability together in one tape coating |

Thus, all of the tabulated approaches lead to complicated, difficult to maintain and/or messy equipment. A new approach to labeling hot glass for identification, therefore, is needed.

BRIEF SUMMARY OF THE INVENTION

Method for marking hot glass article having a surface uses a flexible carrier ribbon bearing a laser ablatable, high temperature, diffusely reflective coating, preferably white in color. A pattern is imaged in said coating on carrier ribbon by laser ablation. The patterned carrier ribbon is pressed against the surface only for a time adequate for transferring the patterned coating to the surface. The carrier ribbon then is released from pressing against the surface. A "pattern" for present purposes includes alphanumeric characters, numbers, graphics, and bar codes (e.g., laser scanable and vision system readable bar codes).

BRIEF DESCRIPTION OF THE DRAWINGS

For a fuller understanding of the nature and advantages of the present invention, reference should be had to the following detailed description taken in connection with the accompanying drawings, in which.

The drawings will be described in detail below.

DETAILED DESCRIPTION OF THE INVENTION

Marking of surfaces using a selectively ablated coating has application beyond the marking of hot glass articles. The coating might be liquid or "tacky" (especially if solvent based) paint and reside on the product when ablatively laser imaged. These same coatings also might be applied in two layers. For example, the first underlying layer might be (unablatively imaged) black and the top layer might be ablatively imaged white. This would create indicia, which would have good black/white contrast independent of the underlying product color, such as taught in U.S. Pat. No. 6,007,929.

The invention here proposes a tape coating, which is imaged prior to being pressed upon a warm or hot surface. The remaining patch colorant will be left as an imprint on the product, as if by a (programmable) stamp pad.

The invention, however, will be illustrated by specific reference to the marking of hot glass where high temperatures and short contact times are necessary. Such description is by way of illustration, however, and not by way of limitation of the present invention, as other substrates are appropriate as are variations of the coating carried by the carrier.

Figure 1:
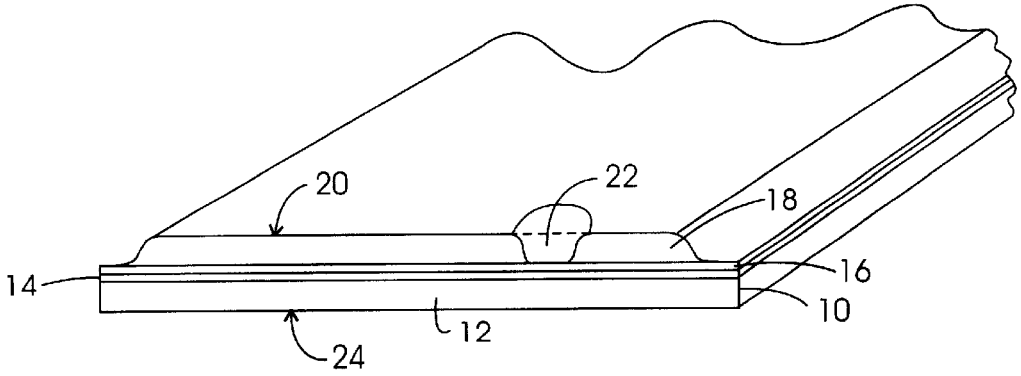
FIG. 1 depicts a cross-section of the carrier bearing the laser ablatable, high temperature, diffusely reflective coating, which has been partially laser ablated.

Referring initially to FIG. 1, shown is an end of a tape that includes a carrier assembly, 10, which can be a single layer (e.g., aluminum foil) or multiple layers. Shown in FIG. 1 is the multiple layer configuration, which includes, for example, an optional supporting structure or backing (e.g., 0.005" thick paper), 12; a heat resistant layer (e.g., 0.001" thick aluminum foil), 14; and an optional (very thin) release layer, 16. Atop carrier assembly 10 is a patch coating, 18. An ablated zone, 22, is shown for illustration in patch coating 18. Patch coating 18 has the following desirable properties:

a. Patch coating 18 contains no significant solvent content (including water), so that a bonding inhibiting barrier (e.g., steam barrier) is not created when the top surface, 20, of coating patch 18 is pressed against hot glass. A low solvent content also will ensure that the tape will not thermally (heat of vaporization) shock or craze the hot glass when pressed against it.

b. Surface 20 is not "sticky" to the outer surface, 24, of backing 12 (i.e., the outer surface of carrier assembly 10) at ambient temperature so that the laminated carrier can be wound into a coil and subsequently freely unwound for use.

c. Surface 20 needs to become tacky or melt when pressed against hot glass in the temperature range of between about 400° C. and 650° C. and the softened coating material 18 needs to wet the hot glass surface upon which it is pressed.

d. Patch coating 18 needs to preferentially go with the hot glass and release from carrier assembly 10 when stripped. Optional release layer 16 can help facilitate this release.

e. The pigments in coating patch 18 generally are white in color and produce a generally white coating patch on the cooled glass, which coating patch on the cooled glass is diffusely reflective of incident (bar code scanner) light.

f. The coating patch on the cooled glass must remain firmly attached to the glass article and not significantly powder or release from the glass as it experiences several subsequent reheat (lehr) cycles.

g. The pigments in coating patch 18 and the composition of the resin in coating patch 18 together produce a patch, which may be cleanly ablated while at or near ambient temperature and while on carrier assembly 10.

In a preferred embodiment, carrier assembly 10 consists of strong paper backing 12 (e.g., 2 to 10 mil inch thick, paper) with aluminum foil layer 14 (e.g., 0.5 to 2 mils thick). Release layer 16 is an acrylic/vinyl film (e.g., 0.00001 to 0.0005 inch thick). Patch coating layer 18 preferably is between about 0.5 and 2 mils thick. The following coating formulation for patch coating 18 has been developed to meet the needs outlined above.

| INGREDIENT | % BY WEIGHT |
|---|---|
| Mono ammonium phosphate (25 wt-% in water) | 69.75 |
| $TiO_2$ (opacifying agent) | 15.0 |
| Ceramic beads (White Zeeospheres 3M Company, St. Paul, MN)) | 15.0 |
| Darvan C (ammonium polymethacrylate dispersing aid, R.T. Vanderbilt Co., Norwalk, CT) | 0.25 |

After formulation, this slurry is applied (e.g., doctor blade, roller, air assisted atomization, etc.) onto carrier 10 and is conductive heat or hot air dried to a state whereby coating layer 18 is dried (is no longer moist) and the tape can be rolled without offsetting or sticking onto carrier back surface 24.

Figure 2:
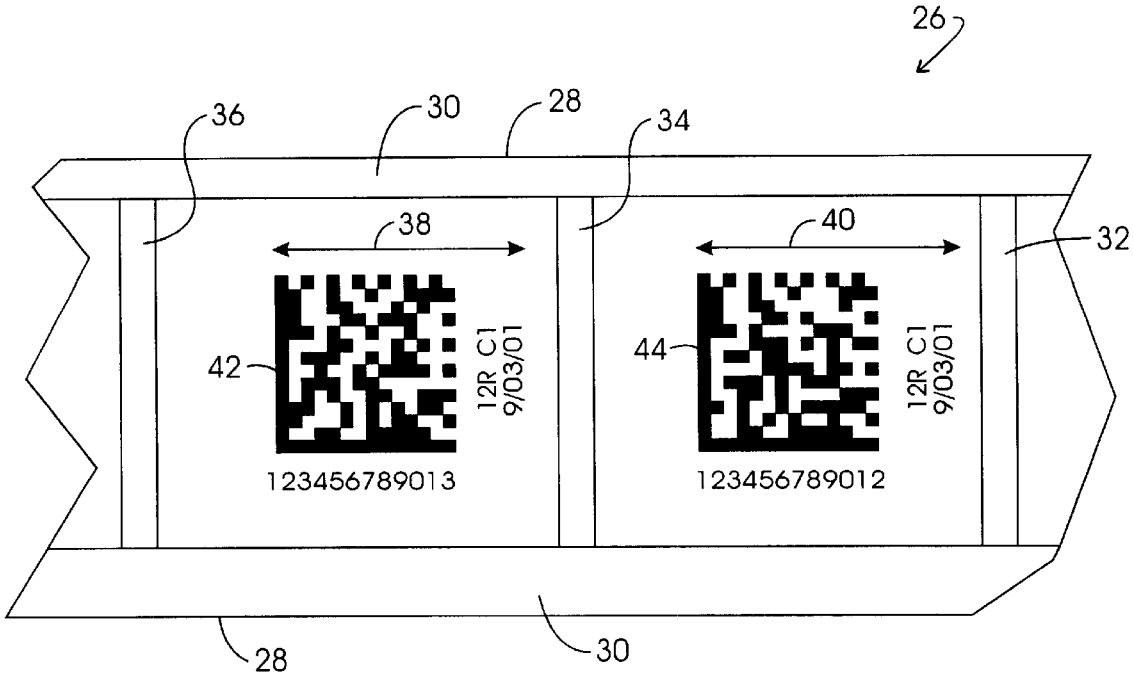
FIG. 2 depicts details on how the image is created on the carrier of FIG. 1.

Referring now to FIG. 2, a tape, 26, having a pair of edges, 28 and 30, is depicted. Tape 26 bears patch coating 18, which is separated into frames by edge bands, 28 and 30, and interlabel strips, 32, and 34, and 36. During laser ablation, edge bands 28 and 30 can be laser ablated to avoid build up on the application pressure roller or pad, while interlabel strips 32, and 34, and 36, can be laser ablated to provide clean edges on the transferred label at the leading and trailing edges.

A pair of frames, 38 and 40, are depicted in FIG. 2 and are representative of a series of frames formed in tape 26. Patch coating 18 is ablatively removed (where shown in black) to produce areas where the coating is absent and will not be transferred onto the hot glass or other object being marked. The ablated zones (e.g., zone 22 in FIG. 1), thereby, appears "black" to a scanning laser when scanning the indicia, 42 and 44, marked on tape 26, because the scanning beam either passes through the article (e.g., glass) or the article (e.g., leaded glass) appears black when compared to the transferred, diffusively reflecting coating white forming images 42 and 44. It should be noted that the images 42 and 44 depicted in FIG. 2 are as seen from the backside of carrier 10 (i.e., as viewed from side 24). The laser markings, images 42 and 44, must be mirror images of the desired ultimate markings on the glass article subject to marking.

Figure 3:
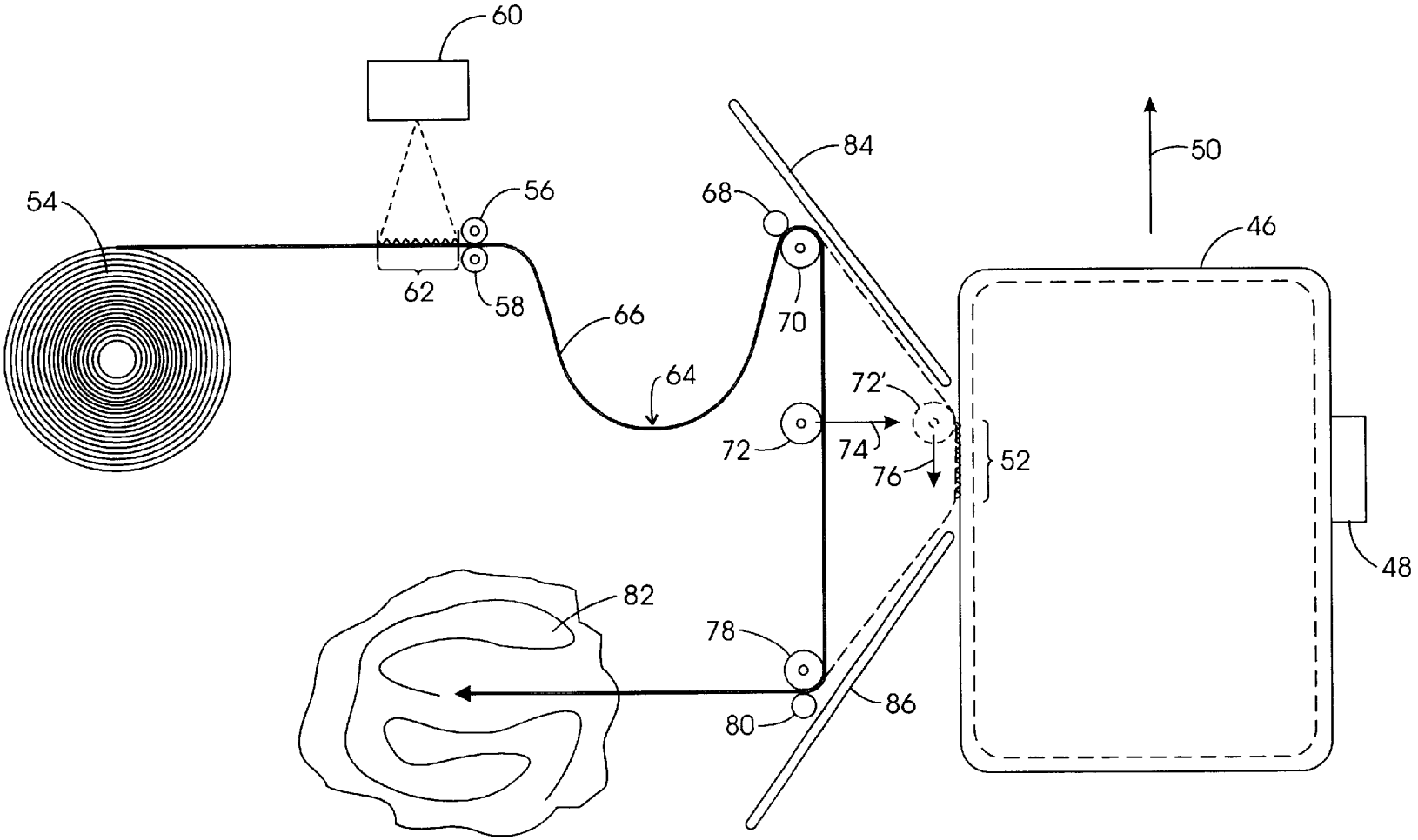
FIG. 3 is a plan view of a system designed to label hot glass picture tube panels with the carrier of FIG. 1.

FIG. 3 illustrates the use of coated ribbon 26 to coat a hot glass picture tube panel, 46. Panel 46 (shown seal edge down) is momentarily stopped (e.g., for 1 second) against an indexing stop, 48, while progressing generally in the direction of arrow 50. The scheme set forth in FIG. 3 is designed to mark a lip, 52, of glass panel 46.

Wound tape or ribbon 26 is supplied as a free wheeling supply roll, 54. A drive roller 56, pressured against an idler roller, 58, advances ribbon 26 one frame at a time from roll 54. A laser marking unit, 60, selectively and ablatively removes selected coating material at the area designated by numeral 62 such that the remaining coating region defines, for example, the (mirror image) white of the ultimate label to be applied at lip 52 of glass panel 46. Alternatively, the ablative coating removal could proceed using a one-axis galvanometer, while drive roller 56 is stepped in the manner as taught in U.S. Pat. No. 5,855,969.

The laser marking described above is repeated whenever a sensor, 64, determines that a supply loop, 66, needs more tape or label material. The information or data printed at zone 62 will be applied to a glass panel or funnel several units of production behind glass panel 46 shown in FIG. 3. Of course, the plant operator must ensure registry and correspondence between the label and the glass panel marked therewith.

When a new panel appears at stop 48, e.g., panel 46, a second drive roll, 68, working against a second idler, 70, advances tape 26 such that a new selectively marked label will be pressed against lip 52 when a roller, 72, is brought forward to the position identified by numeral 72' by an actuator, 74 (details not shown in FIG. 3, but are provided in conventional fashion). After actuator 74 is engaged, a second actuator, 76 (again details not shown in FIG. 3, but are provided in conventional fashion), draws application roller 72' across lip 52, thereby impressing the remaining label coating onto lip 52 in a manner that produces a "nip". To accomplish this nip, a constant (CW) torque is applied by a drive roller, 78, against an idler, 80. Alternatively, a relatively flat foam pad formed from a temperature resistant material, such a silicone rubber, can replace roller 72 and be used to simply "tamp" the image onto lip 52 in one very brief stroke. Upon advancement of tape 26, a label length of scrap (the carrier segment from a previous label) is fed into a scrap barrel, 82.

Since glass panel 46 is hot (e.g., in the range of from about 400° C. to 650° C.), shield plates, 84 and 86, limit the exposure of tape 26 (and the coating pattern it carries) from this heat. Shield plates 84 and 86 can be fabricated, for example, from reflective, low emissivity aluminum, or other suitable heat-resistant metal, ceramic, or like material.

While the foregoing procedure describes a general technique for producing imaged labels for application to hot glass, work on the present invention has revealed that the application of the imaged label to a hot glass article is sensitive to a variety of variables: (1) pressing time, (2) pressure applied, (3) temperature dependent cure/flow rate of the coating, and (4) the mechanical limits on the contact/pressure pad or roller. Controlling all four of these variables in a production machine presents the operator with a very difficult task.

Figure 4:
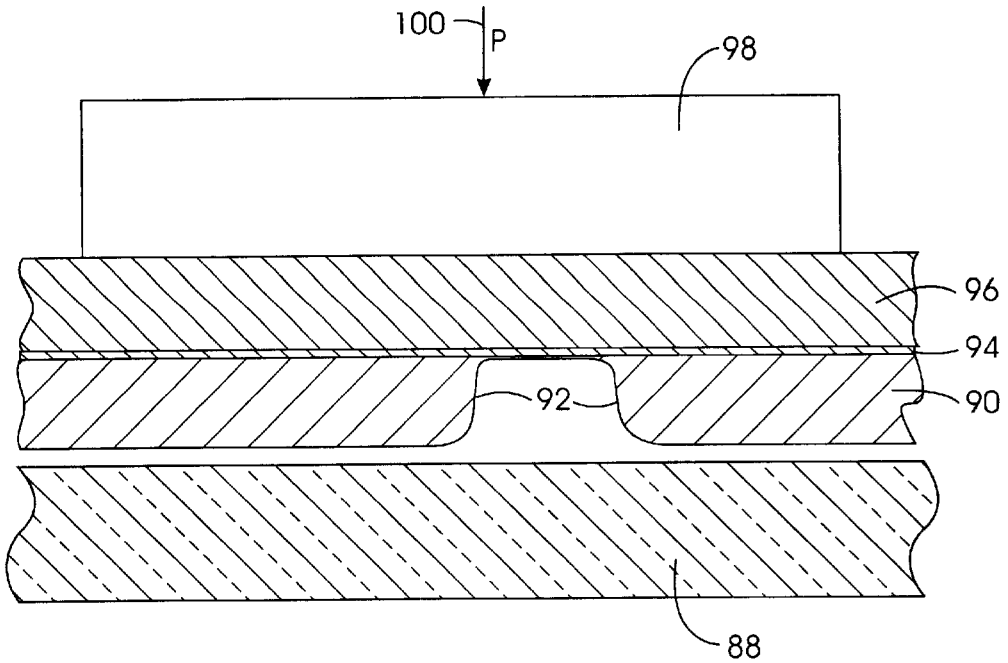
FIG. 4 is an enlarged view of the carrier of FIG. 1 being pressed against a hot glass panel.

FIG. 4 illustrates the problem the operator faces: attempting to identify a hot product, 88, using a coating, 90, of nominal thickness, $T_0$, which has been laser ablatively patterned, as at 92. A carrier, constructed from a foil, 94, and substantial substrate, 96 (e.g., paper), carries coating 90 to product 88. A pressure pad or roller, 98, and pressure, P, in the direction of arrow 100, are utilized to imprint patterned coating 90 onto hot product 88. Unfortunately, at the hot glass temperatures encountered (e.g., in the range of from about 400° C. to 650° C.), coating 90 is rapidly heated and flows freely. Even when the pressure, P, is small, the free flowing coating, unless inhibited, tends to continuously thin and, thereby, flows into ablated areas openings (e.g., area 92) in coating 90, thus, closing them or filling them in. When these ablated areas become filled in, the pattern is lost or distorted, and cannot be properly read by laser scanners/readers.

Also, it is impractical to mechanically "flat" limit the compression of (nearly liquid) coating 90 over the relatively large indicated label area (e.g., 1 sq. in.) upon a variably dimensioned product.

Figure 5:
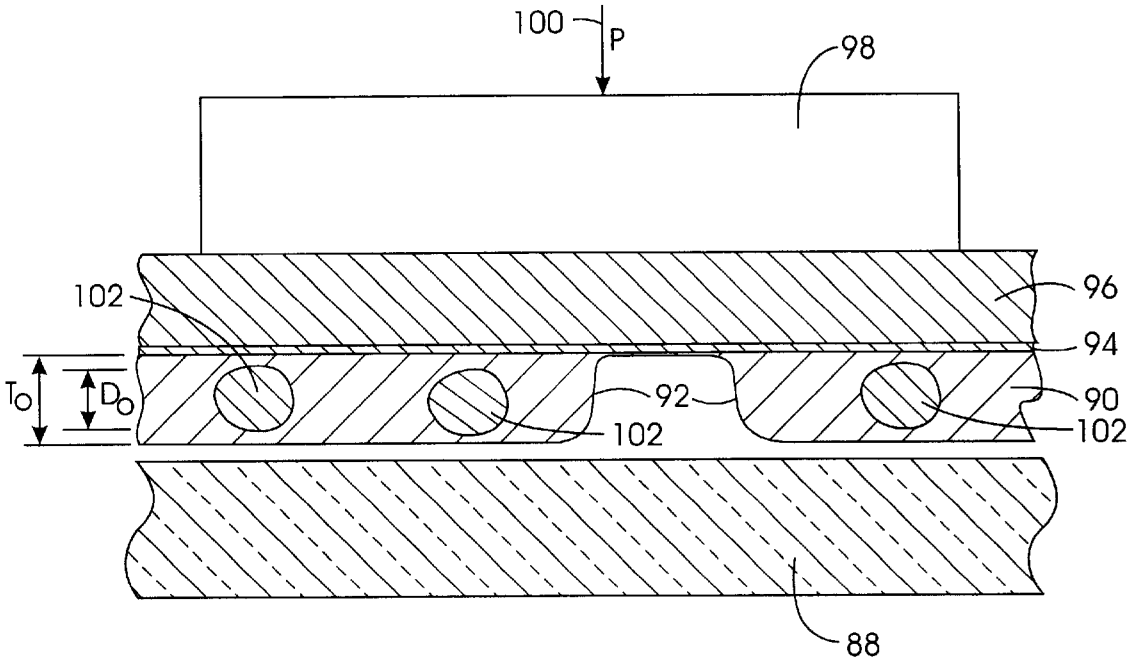
FIG. 5 is an enlarged view like FIG. 4, except that large particles have been added to the laser ablatable, high temperature, diffusely reflective coating carried by the carrier.

The solution to this conundrum is illustrated in FIG. 5. Coating 90 is seen to contain thinning limiting particles, 102. Limiting particles 102 are sized to be nominally smaller in diameter than nominal coating thickness $T_0$. The nominal size of limiting particles 102 is $D_0$, wherein $T_0>D_0$. Under the influence of pressure 100 (and the high temperature of hot glass article 88), coating 90 flows in all directions until the thickness of softened coating 90 reaches a nominal thickness of $D_0$.

The use of limiting particles 102, wherein $T_0>D_0$, will not prevent a partial closure of ablated area 92. Because the liquefied coating is incompressible, a large area of coating 90 might flow parallel to hot article 88 to fill any available voids, e.g., area 92, while thinning from $T_0$ to $D_0$. Therefore, it is important to limit the residual flow, parallel to the surface of hot article 88 to limit the closings of laser cuts, such as cut 92.

Techniques to further limit such undesirable flow include:

1. reduce the contact (pressing) time to minimize the time during which such (viscosity limited) flow is forced.
2. provide a "highly volatile" thin release layer between foil 94 and coating 90, such as, for example, nitro cellulose. This release layer helps to "loft" the approaching coating 90 from carrier foil 94 onto hot article 88 and, thereby, minimize the necessary contact time. There also is the possibility of utilizing such lofting to transfer coating 90 even if limiting particles 102 are larger in size (diameter) than $T_0$ (thereby preventing any significant parallel flow).

While the invention has been described with reference to a preferred embodiment, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In this application all units are in the metric system and all amounts and percentages are by weight, unless otherwise expressly indicated. Also, all citations referred herein are expressly incorporated herein by reference.

What is claimed is:

1. Method for marking a hot article having a surface, which comprises the steps of:

(a) providing a flexible carrier ribbon bearing a laser ablatable, high temperature, diffusely reflective coating;

(b) imaging a pattern on said carrier ribbon by laser ablation;

(c) pressing said patterned carrier ribbon against said surface only for a time adequate for transferring said patterned coating to said surface; and (d) releasing said carrier ribbon from pressing against said surface.

2. The method of claim 1, wherein said hot article is hot glass.

3. The method of claim 2, wherein said hot glass article is a picture tube component.

4. The method of claim 2, wherein said hot glass is at a temperature ranging from about 400° C. to about 650° C.

5. The method of claim 1, wherein said patterned carrier ribbon is pressed against said surface with one or more of a pad or a roller.

6. The method of claim 1, wherein said carrier is formed from a heat resistant foil carrying said coating.

7. The method of claim 6, wherein said foil is carried by a support backing.

8. The method of claim 7, wherein a release layer is interposed between said foil and said backing, but no release layer is interposed between said foil and said coating.

9. The method of claim 1, wherein said coating contains substantially no volatile solvent.

10. The method of claim 9, wherein said carrier ribbon is supplied as a rolled coil.

11. The method of claim 1, wherein said coating is white in color.

12. The method of claim 11, wherein said coating is formulated from mono ammonium phosphate, $TiO_2$, ceramic beads, and a dispersing agent.

13. The method of claim 1, wherein said coating contains limiting particles having a nominal thickness, $D_0$, said coating has a nominal thickness, $T_0$, wherein $T_0>D_0$.

14. The method of claim 1, wherein said pattern is a mirror image of the ultimate product indicia and is readable by an automatic identification reader.

15. The method of claim 14, wherein said pressing is for a time and at a pressure adequate to preclude the coating of said transferred pattern from filling the pattern such that said pattern is not readable by an automatic identification reader.

16. A ribbon useful in marking of hot articles, which comprises:

(a) a flexible carrier ribbon;

(b) a laser ablatable, high temperature, diffusely reflective coating carried by said flexible carrier ribbon, said coating being transferable to a hot article when pressed against said hot article, said coating having a thickness, $T_0$, said coating containing limiting particles having a thickness, $D_0$, wherein $T_0>D_0$.

17. The ribbon of claim 16, wherein a pattern has been formed in said coating by laser ablation of said coating in the form of said pattern.

18. The ribbon of claim 17, which bears a sequential plurality of said patterns.

19. The ribbon of claim 18, which has been wound in a roll.

20. The ribbon of claim 16, wherein flexible carrier ribbon is a metallic foil that carries said coating.

21. The ribbon of claim 20, wherein a support backing carries said foil.

22. The ribbon of claim 21, wherein a release layer is interposed between said foil and said coating.

23. The ribbon of claim 16, wherein said coating is white in color.

24. The ribbon of claim 23, wherein said coating is formulated from mono ammonium phosphate, $TiO_2$, ceramic beads, and a dispersing agent.

* * * * *